United States Patent [19]

Klimaszewski

[11] 4,257,226

[45] Mar. 24, 1981

[54] BY-PASS VALVE

[75] Inventor: Leo T. Klimaszewski, Westland, Mich.

[73] Assignee: ACF Industries, Incorporated, New York, N.Y.

[21] Appl. No.: 972,876

[22] Filed: Dec. 26, 1978

[51] Int. Cl.[3] ..... F02B 75/10

[52] U.S. Cl. ..... 60/290

[58] Field of Search ..... 60/290

[56] References Cited

U.S. PATENT DOCUMENTS

| | | | |
|---|---|---|---|
| 3,924,409 | 12/1975 | Heilman | 60/290 |
| 3,975,905 | 8/1976 | Shimo | 60/290 |
| 4,033,125 | 7/1977 | Inada | 60/290 |
| 4,050,249 | 9/1977 | Collins | 60/290 |
| 4,070,830 | 1/1978 | Beiswenger | 60/290 |
| 4,178,755 | 12/1979 | Klimaszewski | 60/290 |

*Primary Examiner*—Michael Koczo, Jr.
*Attorney, Agent, or Firm*—J. Joseph Muller

[57] ABSTRACT

A by-pass valve (1) for use in the exhaust system of an internal combustion engine has an improvement comprising control means (69) responsive to engine vacuum for exposing a chamber (27) to engine vacuum, the control means being responsive to an abrupt change in engine vacuum such as occurs during engine decelerations for spoiling the vacuum in the chamber and causing a vacuum responsive means (19) to close a first valve (15) and open a second valve (17). The control means reestablishes the vacuum in the chamber after a predetermined time interval and causes the vacuum responsive means to open the first valve and close the second valve, the controlled opening and closing of the first and second valves preventing engine backfires.

3 Claims, 3 Drawing Figures

BY-PASS VALVE

BACKGROUND OF THE INVENTION

This invention relates to air by-pass valves and, more particularly, to an improvement in a by-pass valve in which controlled air dumps are made during decelerations to prevent engine backfires.

By-pass valves are typically used in the air injection system of an internal combustion engine to supply air to the catalytic converter installed in the exhaust system thus to obtain more complete combustion of fuel and reduced exhaust emissions. One problem encountered with the use of by-pass valves is engine backfires which may occur when the engine is decelerated. Engine backfires may be prevented, if during an engine deceleration, the supply of air to the exhaust is shut off. However, it is important that the time interval during which air is shut off be properly controlled. If the shut off interval is too short, engine backfire may still occur. If the interval is too long, unburned fuel will be exhausted through the converter thus increasing engine emissions.

SUMMARY OF THE INVENTION

Among the several objects of the present invention may be noted the provision of an improved by-pass valve; the provision of such an improved by-pass valve which is responsive to engine decelerations to shut off air flow through the by-pass valve and thereby prevent engine backfires; and, the provision of such an improved by-pass valve in which air shut off is so controlled that air flow through the valve is restored at a predetermined time interval after shut off thereby to aid in reducing engine emissions.

Briefly, an improvement in a by-pass valve for use in the exhaust system of an internal combustion engine comprises control means responsive to engine vacuum for exposing a chamber to engine vacuum, the control means being responsive to an abrupt change in engine vacuum such as occurs during engine decelerations for spoiling the vacuum in the chamber and causing a vacuum responsive means to close a first valve and open a second valve. The control means reestablishes the vacuum in the chamber after a predetermined time interval thus causing the vacuum responsive means to open the first valve and close the second valve. The controlled opening and closing of the first and second valves prevents engine backfires. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
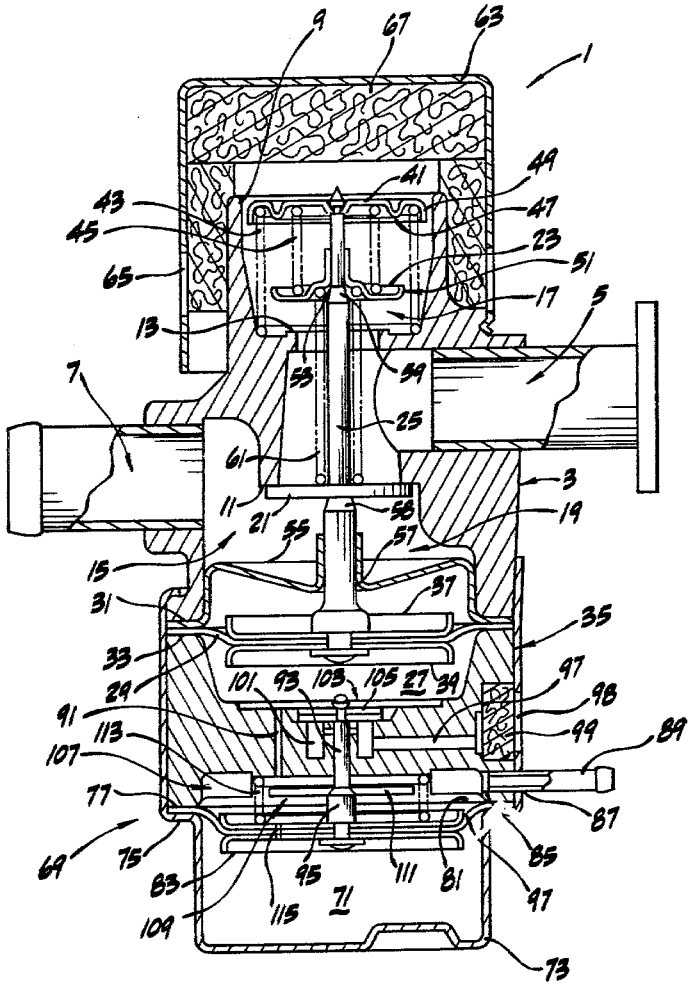
FIG. 1 is a sectional view of a by-pass valve illustrating the improvement of the present invention.

Referring to the drwings, a by-pass valve for use in the exhaust system of an internal combustion engine (not shown), is indicated generally 1 and has a main body 3 which defines an air inlet port 5, first and second air outlets 7 and 9 respectively, and valve seats 11 and

13 respectively. Inlet port 5 is connected to an air pump (not shown) which delivers air to by-pass valve 1. Air outlet 7 is connected to a catalytic converter (also not shown) in the exhaust system of the engine. Delivery of air to the converter aids in helping the converter reduce engine emissions. Air outlet 9 allows air to be diverted from the converter and dumped to the atmosphere.

A first valve 15 normally closes the air flow path between inlet 5 and outlet 7 while a second valve 17 normally opens the air flow path between the inlet and outlet 9. Means generally designated 19 is responsive to engine vacuum for simultaneously opening the first valve and closing the second valve when engine vacuum reaches a predetermined level. For this purpose, valve 15 comprises a valve head 21 and valve 17 a valve head 23; the valve heads being commonly mounted on a valve stem or shaft 25.

Vacuum responsive means 19 includes a means defining a chamber 27 exposable to engine vacuum. As shown in FIG. 1, the lower portion of valve body 3 is hollow. A flexible diaphragm 29 is annular shaped and its outer margin is clamped between a rim 31 defined by the lower end of valve body 3 and a rim 33 defined by the upper end of a valve body member 35. The upper portion of body member 35 is hollow and the space enclosed by diaphragm 31 creates chamber 27. As will be described hereinafter, chamber 27 is exposed to engine vacuum and when it is, the underside of diaphragm 29 is subjected to engine vacuum.

The diaphragm is sandwiched between a pair of backing plates, 37 and 39 respectively, and the lower end of shaft 25 is attached to the diaphragm assembly. A plate 41 is attached to the upper end of the shaft and the plate acts as a seat for a pair of bias springs 43 and 45 respectively. Spring 43 is a compression spring which also seats against the bottom surface of air outlet 9 and urges the diaphragm assembly upwardly. A circumferential ridge 47 is formed on the underside of plate 41 inwardly of the outer margin of the plate. The outer margin of the plate is turned down to form a lip 49. Spring 43 seats in the channel formed by the ridge and the lip while spring 45 seats against the bottom surface of the plate inwardly of the ridge.

Valve head 23 is disk shaped and its outer margin is turned up to form a lip 51. The disk has a central opening 53 for the valve head to be slideable on shaft 25. The inner margin of the disk about the central opening is upwardly turned to form a collar or sleeve surrounding the shaft. Spring 45 bears against the upper surface of the valve head.

An annular separator 55 has an inverted cup shape and its lower margin is outwardly turned and pressed between rims 31 and 33 when the by-pass valve is assembled. The base of the cup has a central opening 57 in which shaft 25 is received and the inner margin of the base, about this opening, is upwardly turned to form a guide for the shaft as it moves up and down. Shaft 25 extends upwardly through the separator and has a first shoulder 58 at the point along its length where valve member 21 is mounted on the shaft. The shaft has a second shoulder 59 at its upper end at the point where valve member 23 is mounted on the shaft. A spring 61 is inserted over the shaft during assembly of the by-pass valve. The ends of the spring respectively seat against the upper surface of valve member 21 and the lower surfce of valve member 23.

A one-piece thin-wall housing 63 of sheet metal construction fits over the upper end of valve body 3. Housing 63 is cup shaped and has a plurality of openings 65 through which air directed to outlet 9 is dumped to the atmosphere. A sound deadening material 67 is used to reduce the noise created by the rush of air passing to the atmosphere through outlet 9 and openings 65.

Operation of a by-pass valve 1 as thus far described is well known in the art; viz, when chamber 27 is subjected to slight engine vacuum level, spring 43 overcomes the vacuum force to which diaphragm 31 is subjected and the shaft is maintained in its position shown in FIG. 1, i.e. valve 15 is closed and valve 17 is open. Air delivered to inlet 5 from the air pump is thus dumped to atmosphere rather than being delivered to the catalytic converter. When the engine vacuum level is sufficiently high, the force on the diaphragm overcomes the force exerted by spring 43 and shaft 25 is pulled downwardly thus opening valve 15 and closing valve 17. This is the condition shown in FIG. 2, with air from the pump now being routed to the converter. This condition is maintained so long as engine vacuum remains sufficiently high. If, for some reason, the flow path to the converter, downstream from the by-pass valve, is obstructed, the backpressure exerted on valve 17 is sufficient to overcome the force exerted on valve member 23 by spring 45 and the valve member lifts off its seat. Air entering the by-pass valve now flows to outlet 9 and is again dumped to the atmosphere.

The improvement of the present invention to the above described by-pass valve comprises a control means, generally designated 69, responsive to engine vacuum for exposing chamber 27 to engine vacuum. The control means is responsive to an abrupt change in engine vacuum such as occurs during engine decelerations for spoiling the vacuum in chamber 27. As will be described hereinafter, the spoiling of the vacuum in chamber 27 causes vacuum responsive means 19 to reclose valve 15 and reopen valve 17. As shown in FIG. 1, control means 69 comprises means defining a second chamber 71. Body portion 35 of by-pass valve 1 has a cavity formed in its lower end and a one-piece thin-wall housing 73 of sheet metal construction fits over the lower end of body portion 35. Housing 73 is cup shaped with an annular shoulder section 75 that abuts against a circumferential rim 77 defined by the lower end of body portion 35. The side of housing 73 extends upwardly and encloses the lower end of valve body 3. Chamber 71 is defined by the lower end of body portion 35 and housing 73.

A second flexible diaphragm 79 is annular shaped and its outer margin is clamped between shoulder 75 of housing 73 and rim 77 of body portion 35. Diaphragm 79 is positioned across chamber 71 and is sandwiched between a pair of backing plates, 81 and 83 respectively. Body portion 35 has a horizontal passage 85 extending from chamber 71 to the outside of the body portion. An opening 87 is formed in the side of housing 73 in registry with the passage and a nipple 89 is press fit or otherwise inserted into the passage through the opening. Nipple 89 is connected to the inlet manifold of the engine by a suitable hose connection (not shown) so chamber 71 is exposed to engine vacuum. The upper side of diaphragm 79 is thus subjected to engine vacuum. In addition, body portion 35 has a vertical passage 91 extending between chamber 71 and chamber 27. Thus, chamber 27 is exposed to engine vacuum simultaneously with chamber 71 and the lower side of diaphragm 29 is subjected to the vacuum.

Body portion 35 has a second vertical passage 93 extending between chambers 71 and 27. A second shaft 95 is movable in this second passage and the lower end of the shaft is attached to the second diaphragm assembly so as to move as the diaphragm flexes in one direction or the other. The upper end of shaft 95 extends into the lower region of chamber 27.

Body portion 35 has a second horizontal passage 97 which opens to the atmosphere through an opening 98 in the side of housing 73. The outer end of this air passage is filled with a filtering material 99 and the inner end of the passage intersects a circumferential passage 101 which encircles vertical passage 93. The upper end of passage 101 opens into chamber 27 and passages 97 and 101 therefore define means for spoiling the vacuum in the chamber.

Control means 69 further comprises a third valve 103 for opening and closing the outlet of air passage 101. Valve 103 includes a valve member or pad 105 attached to the upper end of shaft 95. A means, generally designated 107 acts on diaphragm 79 to bias valve 103 closed. The control means still further comprises a fourth valve 109 for opening and closing one end, the lower end, of passage 91. Valve 109 includes a valve member or pad 111 attached to shaft 95 at place intermediate the ends of the shaft, the position being on a portion of the shaft that moves within chamber 71, and such that when valve 103 is closed, pad 111 is spatially separated from the upper surface of the chamber and the lower end of passage 91. When the diaphragm assembly moves upwardly to open valve 103, pad 111 is pressed against the upper surface of the chamber. The pad is of sufficient diameter that when so pressed, it covers the lower end of passage 91, blocking the passage so chamber 27 is no longer exposed to engine vacuum.

Bias means 107 comprises a coil spring 113 which seats against the upper surface of chamber 71 and bears against the upper surface of backing plate 81. The spring urges the diaphragm 81 assembly downwardly so as to close valve 103 and open valve 109.

Control means 69, besides spoiling the vacuum in chamber 27, also reestablishes the vacuum in the chamber after a predetermined time interval. When the vacuum is reestablished, vacuum responsive means 19 reopens valve 15 and closes valve 17. For this purpose, diaphragm 79 has a bleed hole 115 by which the vacuum pressure on both sides of the diaphragm is equalized. When a change in engine vacuum occurs, there is a momentary inequality between the pressure levels on the opposite sides of diaphragm 79. After a time determined by the size of bleed 115, the pressures equalize and spring 113 overcomes the vacuum force on the upperside of diaphragm 79 and pushes the diaphragm assembly downwardly.

Figure 2:
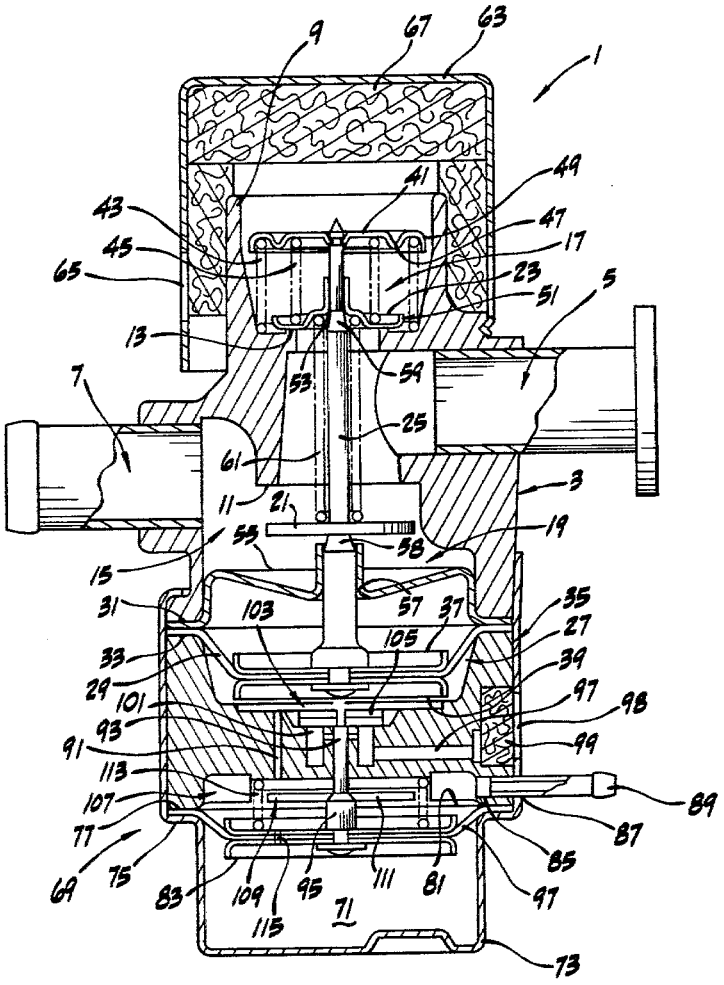
FIGS. 2 and 3 are sectional views of the by-pass valve shown in FIG. 1 illustrating the operation of the by-pass valve in accordance with the teachings of the present invention.
Figure 3:
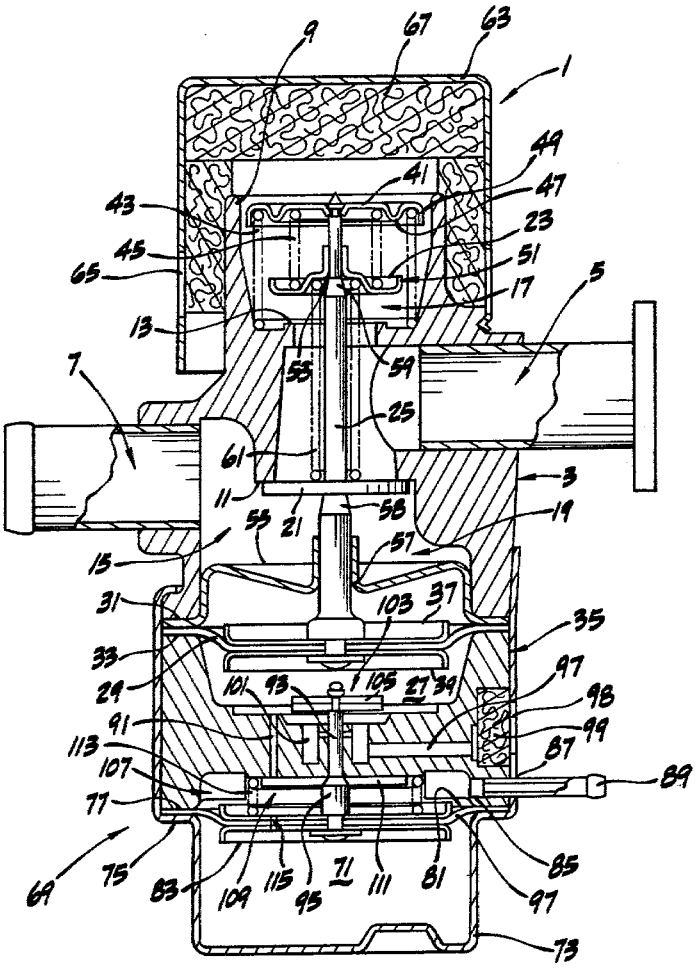

In operation, the configuration of by-pass valve 1 is that shown in FIG. 2 when engine vacuum is essentially constant, that is, spring 111 urges diaphragm 79 downwardly, closing valve 103 and opening valve 109. Both chamber 71 and chamber 27 are exposed to engine vacuum; the vacuum in chamber 27, if it is sufficiently high, causing means 19 to open valve 15 and close valve 17 as previously described. When an abrupt change in engine vacuum occurs, such as when the engine is decelerated, the vacuum pressure in chamber 71 becomes quite high and the upper side of diaphragm 79 is momentarily subjected to a much greater vacuum than the underside of the diaphragm. If the vacuum in chamber 71 is sufficiently high, diaphragm 79 moves upwardly against the force of spring 113. This seats pad 111 against the inlet of passage 91 (closing valve 109) and moves pad 105 away from the upper portion of passage 101 (opening valve 103). Chamber 27 is now exposed to the atmosphere and the vacuum in the chamber is spoiled. As a result, spring 43 forces diaphragm 29 upwardly closing valve 15 and opening valve 17. This is the condition shown in FIG. 3.

After a period of time determined by the size of bleed 115, the pressure on both sides of diaphragm 79 equalizes and spring 113 urges the diaphragm downwardly to the position shown in FIG. 2. As a result, valve 109 is reopened and valve 103 reclosed. Chamber 27 is again exposed to engine vacuum and vacuum responsive means 19 reopens valve 15 and recloses valve 17.

What is claimed is:

1. An improved by-pass valve for use in the exhaust system of an internal combustion engine comprising a main body in which is defined an air inlet, first and second air outlets, and air flow paths between the air inlet and the respective air outlets; a first valve normally closing the air flow path between the air inlet and the first air outlet and a second valve normally opening the air flow path between the air inlet and second air outlet; a valve body member located beneath the main body, the upper and lower portions of the main body and the upper and lower portions of the valve body member being hollow; means responsive to engine vacuum for simultaneously opening the first valve and closing the closing the second valve, the vacuum responsive means including a first flexible diaphragm clamped between the main body and the valve body member whereby a first vacuum chamber exposable to engine vacuum is defined by the diaphragm and the hollow upper portion of the valve body member, a first shaft on which the first and second valves are commonly mounted, one end of the first shaft being secured to the diaphragm for movement therewith; and control means responsive to engine vacuum for exposing the first vacuum chamber to engine vacuum, the control means being responsive to abrupt changes in engine vacuum such as occur during engine decelerations for spoiling the vacuum in the first vacuum chamber and causing the vacuum responsive means to reclose the first valve and reopen the second valve, the control means reestablishing the vacuum in the first vacuum chamber after a predetermined time interval and causing the vacuum responsive means to reopen the first valve and reclose the second valve, the control means including a housing fitting over the lower end of the valve body member, a second diaphragm clamped between the housing and the valve body member to define a second vacuum chamber exposable to engine vacuum whereby one side of the second diaphragm is exposed to engine vacuum, a first passage formed in the valve body member by which the hollow lower portion of the valve body member is exposed to engine vacuum, a bleed hole formed in the second diaphragm whereby the vacuum present on the one side of the second diaphragm is communicated to the second vacuum chamber, a second passage formed in the valve body member and extending between the upper and lower hollow portions of the valve body member whereby both the first and second vacuum chambers are simultaneously exposed to engine vacuum, a third passage formed in the valve body member and extending between the upper and lower hollow portions thereof, a second shaft movable within the third passage and having one end connected to the second diaphragm for movement therewith, an air passage formed in the valve body member and having an outlet communicating with the first vacuum chamber, a third valve mounted on one end of the second shaft for opening and closing the outlet of the air passage, a fourth valve mounted on the second shaft intermediate the ends thereof for closing one end of the first passage, and means biasing the second diaphragm to close the third valve and open the fourth valve, the second diaphragm overcoming operation of the bias means upon an abrupt change in engine vacuum to open the third valve and close the fourth valve whereby air is admitted into the first vacuum chamber to spoil the vacuum therein which results in the vacuum responsive means closing the first valve and opening the second valve thus to prevent engine backfires.

2. An improved by-pass valve as set forth in claim 1 wherein the bias means comprises a spring.

3. An improved by-pass valve as set forth in claim 1 wherein the side of the housing is sufficiently long to enclose the valve body member and the lower end of the main body.

* * * * *